US005404212A

United States Patent [19]

Ditomaso

[11] Patent Number: 5,404,212

[45] Date of Patent: Apr. 4, 1995

[54] TONER CARTRIDGE SEAL

[75] Inventor: Daniel Ditomaso, Wallingford, Pa.

[73] Assignee: Laser Ink Ltd., Aston, Pa.

[21] Appl. No.: 126,266

[22] Filed: Sep. 24, 1993

[51] Int. Cl.[6] ..... G03G 15/06

[52] U.S. Cl. ..... 355/260; 222/DIG. 1; 347/86; 355/215; 355/245

[58] Field of Search ..... 355/200, 210, 215, 245, 355/260; 222/DIG. 1; 347/84, 86

[56] References Cited

U.S. PATENT DOCUMENTS

| | | | |
|---|---|---|---|
| 4,062,385 | 12/1977 | Katusha et al. | 141/89 |
| 4,778,086 | 10/1988 | Shibata et al. | 222/325 |
| 4,862,210 | 8/1989 | Woolley | 355/245 |
| 4,895,104 | 1/1990 | Yoshino et al. | 118/653 |
| 4,924,920 | 5/1990 | Bhagwat | 141/59 |
| 4,930,684 | 6/1990 | Patterson | 222/325 |
| 4,961,450 | 10/1990 | Furuta | 141/364 |
| 5,018,560 | 5/1991 | Tsukamoto | 141/364 |
| 5,027,156 | 6/1991 | Kobayashi | 355/245 |
| 5,034,776 | 7/1991 | Sugiura | 355/260 |
| 5,080,745 | 1/1992 | Paull | 229/123 |
| 5,110,646 | 5/1992 | Prestel et al. | 428/43 |
| 5,150,807 | 9/1992 | Seyfried et al. | 220/359 |
| 5,153,643 | 10/1992 | Nagakura | 355/215 |
| 5,184,182 | 2/1993 | Michlin | 355/260 |
| 5,194,900 | 3/1993 | Hagihara et al. | 355/260 |
| 5,206,619 | 4/1993 | Kita | 355/260 |
| 5,264,901 | 11/1993 | Rossiter | 355/260 |
| 5,267,003 | 11/1993 | Grappiolo | 355/260 |
| 5,335,831 | 8/1994 | Foster | 222/DIG. 1 X |

*Primary Examiner*—A. T. Grimley
*Assistant Examiner*—Sandra L. Brasé
*Attorney, Agent, or Firm*—Woodcock Washburn Kurtz Mackiewicz & Norris

[57] ABSTRACT

A technique for providing an easy to remove leak-proof seal for shipment of a remanufactured toner cartridge. An adhesive-backed sealing strip is disposed over the feed roller of the hopper so that a seal is formed between the mylar blades and the feed roller. The excess portion of the sealing strip is then passed through a foam wiping assembly and out through a slit in the lid of the hopper. The toner is poured into the hopper over the sealed feed roller and the lid is then sealed onto the hopper prior to shipment. Upon receipt by the customer, the excess portion of the sealing strip extending out through the slit in the lid is simply pulled until the sealing strip is completely removed from the feed roller. Excess toner is removed from the sealing strip by the foam wiping assembly so that no toner escapes the hopper to leak onto the user's clothing.

6 Claims, 2 Drawing Sheets

FIG. 2
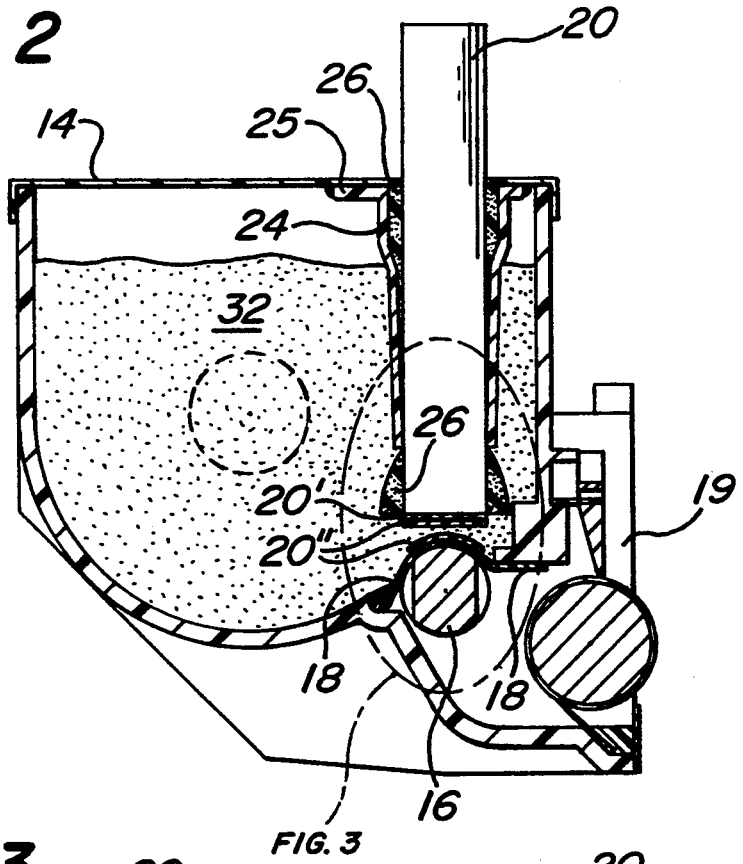
FIG. 3
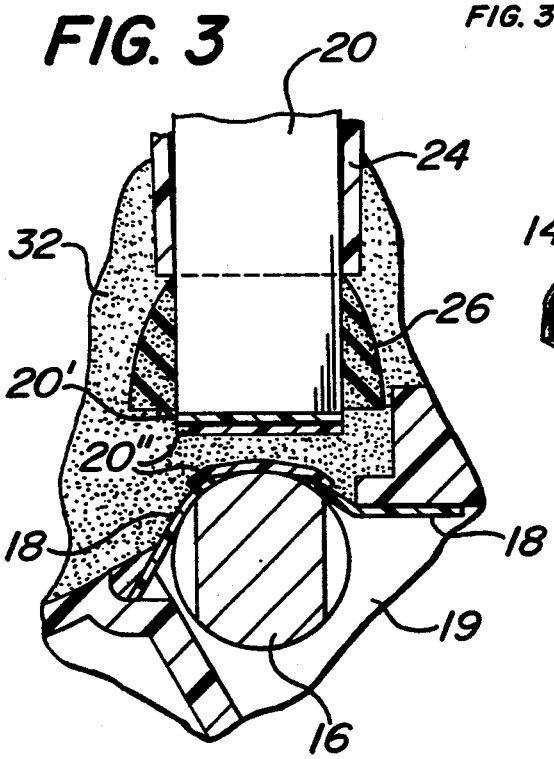
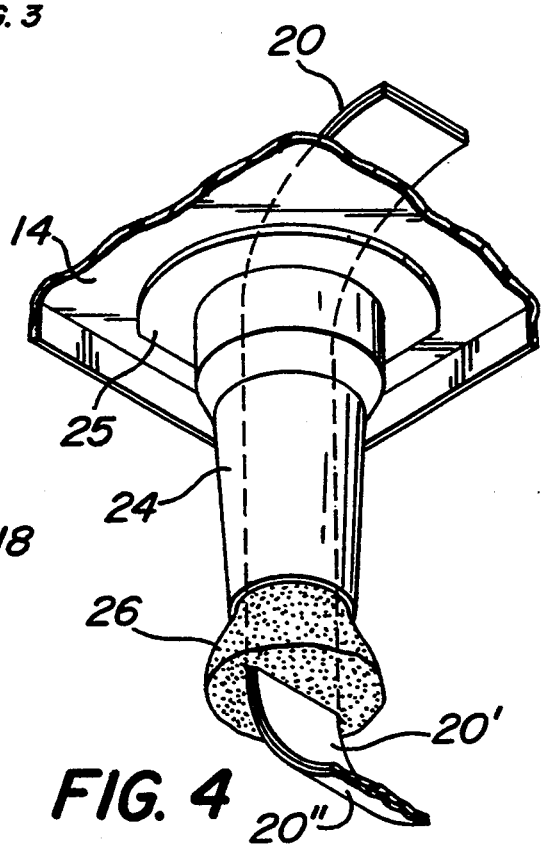
FIG. 4

TONER CARTRIDGE SEAL

BACKGROUND OF THE INVENTION

1. Field of the Invention

The present invention relates to a seal for a toner cartridge and, more particularly, to a process and apparatus for providing an easy to remove seal in a disposable toner cartridge during remanufacture which prevents the leakage of toner during shipment of the remanufactured toner cartridge.

2. Description of the Prior Art

Toner cartridges of the type commonly used with laser printers and the like typically may be used for 2000–20,000 prints before the toner is exhausted. Most laser printer manufacturers direct the user to discard the old toner cartridge, which also includes a magnetic roller, gears and other parts, and to purchase a new cartridge which is filled with toner. For example, the IBM Lexmark 4019, 4028, 4029 and 4039 imaging cartridges are designed to be disposable and are thrown away when the toner is depleted. Since many useful parts are discarded with the empty toner cartridge, disposal of the toner cartridge is quite wasteful and expensive. However, wear and tear on the toner cartridge during use renders simple refilling of the toner cartridge virtually impossible; reconditioning or remanufacturing of the toner cartridge prior to refilling is often necessary. Moreover, it is undesirable for the user to have to deal directly with the toner since it is quite messy.

Numerous companies have taken steps to minimize such waste by remanufacturing or reconditioning toner cartridges for reuse. Remanufacturing of the toner cartridge is a cost effective and environmentally conscientious alternative to disposing of the toner cartridge since it can be done quite readily by replacing all the worn and broken components of the toner cartridge. Unfortunately, remanufacturers continue to have difficulty with shipping the remanufactured and refilled toner cartridges to their customers since it has proven quite difficult to provide a seal which prevents the leakage of the toner out of the remanufactured toner cartridge. This problem has stymied further customer acceptance of remanufactured toner cartridges.

The original equipment manufacturer does not have as much of a problem with toner leakage because, when the toner cartridge is new and filled with toner, all the tolerances of the elements of the toner cartridge are tight by comparison to a used toner cartridge. In other words, fewer gaps are present through which the toner may leak. This is especially true in the critical sealing area around the feed roller due to the material used (mylar and plastic) and the number of prints the typical toner cartridge delivers before running out of toner. Since new toner cartridges may be shipped without substantial toner leakage, many customers still prefer to wastefully dispose of the used toner cartridges and to replace them with new toner cartridges. Accordingly, it is desired to provide a sealing mechanism for remanufactured toner cartridges which substantially prevents the leakage of toner so as to improve customer acceptance of remanufactured toner cartridges.

Numerous attempts have been made in the art to provide seals which prevent the leakage of the toner during shipment of the toner cartridge. For example, an adhesive backed film capable of retaining the toner inside the toner cartridge during shipment has been used to prevent leakage of the toner. Such sealing systems for toner cartridges are described by way of example in the following U.S. Pat. Nos. 4,062,385 to Katusha et al; 4,778,086 to Shibata et al; 4,924,920 to Bhagwat; 4,930,684 to Patterson; 4,961,450 to Furuta; 5,018,560 to Tsukamoto; 5,080,745 to Paull; 5,110,646 to Prestel et al; 5,150,807 to Seyfried et al; 5,153,643 to Nagakura; 5,184,182 to Michlin; and 5,194,900 to Hagihara et al. However, the seals used in those systems are either difficult to remove by the customer, prohibit adequate testing prior to shipment of the remanufactured and refilled toner cartridge, and/or cause a substantial amount of toner to leak out when the seal is removed, thereby causing toner to cover the customer and his or her clothing.

Other seals have been proposed which seal the remanufactured toner cartridge for mailing while further preventing leakage of the toner during removal of the seal. For example, a "wind-up" style seal has been used in which a piece of adhesive backed film is used to obtain a seal at one end of the toner cartridge at the toner feed roller. The other end of the adhesive backed film is attached to a large internal auger which the user turns to slowly wind up the adhesive backed film, thereby removing the adhesive backed film from the toner feed roller and permitting the toner to flow down to the developer roller. Such a system has the advantage that the seal may be removed without leaking toner onto the customer or the customer's clothing. However, due to the slow large internal auger movement, the customer must run approximately 25 prints on the toner cartridge before clean copies may be obtained. A simpler, more easy to use, and less wasteful system is desired.

Still other toner cartridges have been designed which use a removable seal and a wiping element to minimize toner leakage when the seal is removed. For example, as described by Yoshino et al. in U.S. Pat. No. 4,895,104 and Kita in U.S. Pat. No. 5,206,619, the sealing tape may be pulled through a cleaning pad or a sealing member such as a sponge so that the toner is wiped off the adhesive as the seal is removed directly by the user. Such seals are quite easy to remove without the leakage of toner onto the customer or the customer's clothing; however, such seals have not been provided in the context of remanufactured toner cartridges and thus do not account for the variations in the manufacturing tolerances of the feed roller and the like during use. On the contrary, the seals disclosed by Yoshino et al. and Kita are used in conjunction with toner cartridges which the customer uses for refilling reusable toner cartridges and cannot be used over and over again. Thus, an easy to remove seal for toner cartridges which prevents the leakage of toner is still desired in order to improve customer acceptance of remanufactured toner cartridges.

Accordingly, there is a long-felt need in the art for an easy to remove seal which accounts for variations in the manufacturing tolerances of the feed roller and the like during use. The present invention has been designed to meet this need.

SUMMARY OF THE INVENTION

The above-mentioned long-felt need in the art has been met in accordance with the present invention by providing a technique for sealing a remanufactured toner cartridge which prevents leakage of the toner during shipment yet is easy to remove by the customer. In particular, the present invention relates to a seal for use with disposable imaging cartridges. In accordance with the invention, one end of a sealing strip is provided over the mylar blades in contact with the feed roller while the other end of the sealing strip is pulled through a foam wiping assembly which also serves as a seal to prevent the toner in the hopper from leaking outside the toner cartridge. During use, the customer simply pulls the sealing strip from its free end outside of the toner cartridge until the sealing strip is removed from the toner cartridge and the toner is passed to the developer roller. In this manner, the seal is maintained until such time that the customer pulls the end of the sealing strip and removes it from the feed roller. A wiping assembly is used to prevent the toner from being removed from the hopper along with the sealing strip. Since the toner cartridge of the invention may be print tested prior to shipment, the present invention renders it unnecessary for the customer to make numerous prints before obtaining clean copies.

BRIEF DESCRIPTION OF THE DRAWINGS

The objects and advantages of the invention will become more apparent and more readily appreciated from the following detailed description of the presently preferred exemplary embodiment of the invention taken in conjunction with the accompanying drawings, of which:

FIG. 2 illustrates a cross-sectional view along line 2—2 of the toner cartridge of FIG. 1 for better illustrating the sealing mechanism of the invention.

FIG. 3 illustrates an enlarged view of the portion of the toner cartridge within the ellipse of FIG. 3.

FIG. 4 illustrates an enlarged view of the wiper assembly of the sealing mechanism of the invention.

DETAILED DESCRIPTION OF THE PREFERRED EMBODIMENT

Figure 1:
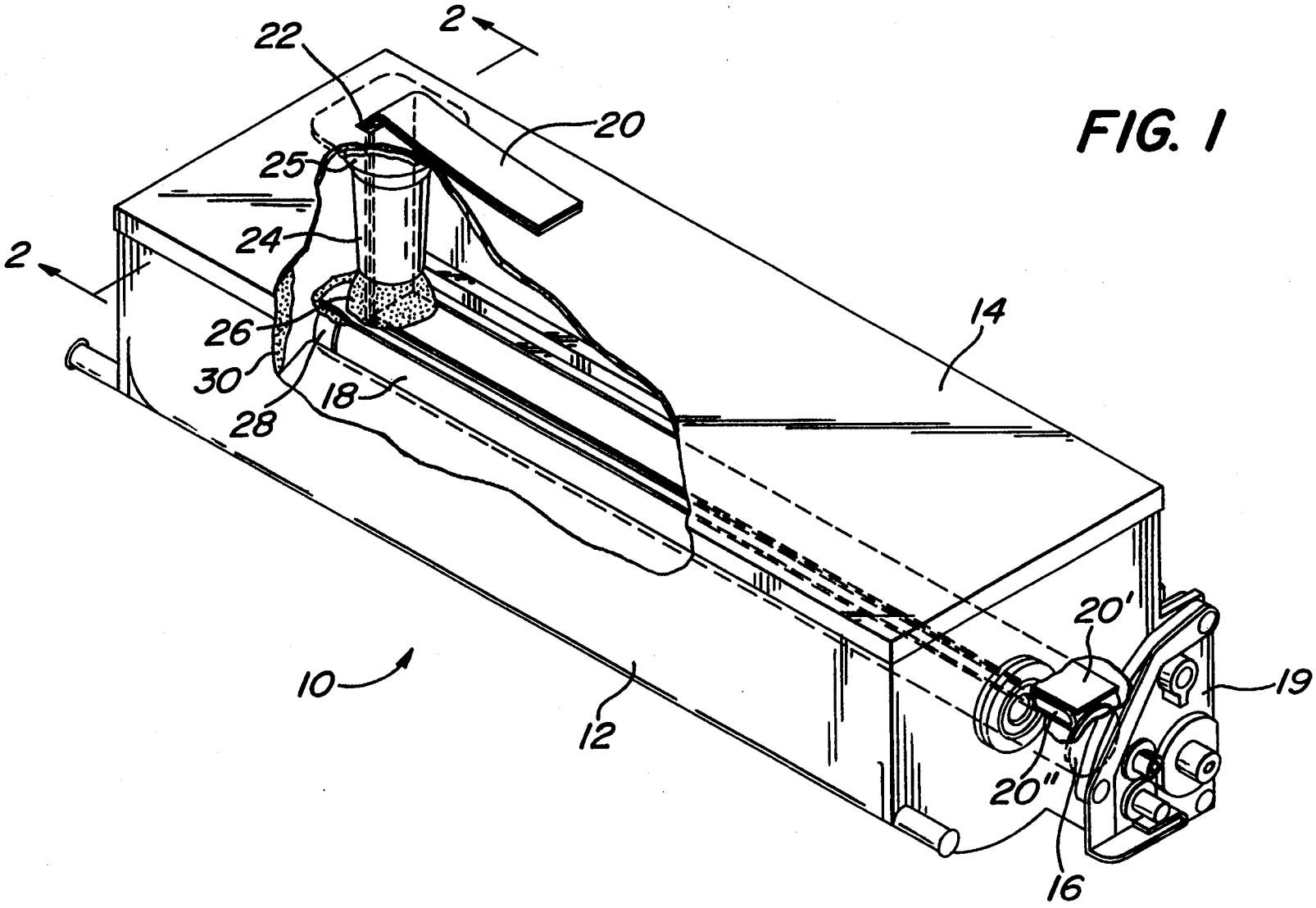
FIG. 1 illustrates a partial cutaway perspective view of a toner cartridge modified to include a sealing assembly in accordance with the invention.

The inventor of the subject matter disclosed and claimed herein has satisfied the above-mentioned long-felt need in the art by developing a sealing mechanism for a toner cartridge which provides a 100% effective seal until the seal is removed by the customer. The seal is readily removed by the customer by pulling a sealing strip through a wiping assembly which removes excess toner from the adhesive to prevent toner from passing out of the hopper onto the customer or the customer's clothing. While the preferred embodiment of the invention is used to seal a disposable imaging cartridge such as the IBM Lexmark model 4019, 4028, 4029 or 4039 imaging cartridges, those skilled in the art will readily appreciate that the seal of the invention also may be used with numerous other disposable toner cartridges to prevent the leakage of toner during shipment. Accordingly, those skilled in the art will appreciate that the description given herein with respect to FIGS. 1–4 is for exemplary purposes only and is not intended in any way to limit the scope of the invention. All questions regarding the scope of the invention may be resolved by referring to the appended claims.

FIG. 1 illustrates a partial cutaway perspective view of a disposable toner cartridge 10 adapted to include a seal in accordance with the invention. Disposable toner cartridge 10 is typically inserted into an imaging cartridge (not shown) which is, in turn, inserted into a laser printer and the like. Disposable toner cartridge 10 comprises a hopper 12 having a lid 14, both of which are preferably formed of inexpensive plastic such as vacuum formed PTFE recycled bottle material. At the bottom portion of the hopper 12 is a feed roller 16 having mylar blades 18 on respective sides thereof for selectively feeding toner down to the assembly 19 including a developer roller and the like for transferring the toner to the appropriate portions of the transfer medium.

In accordance with the invention, disposable toner cartridge 10 is modified to include a sealing strip 20 formed of two layers 20' and 20''. The first layer 20' of the sealing strip 20 may be formed of a polyester film. The second layer 20'' of the sealing strip 20 is preferably formed of a polyester film which is approximately one-half inch wide and has a sticky adhesive on the first ten inches or so of its overall length of approximately twenty-three inches. As better shown in FIG. 2, the second layer 20'' of the sealing strip 20 covers the exposed portion of the feed roller 16 between the mylar blades 18. The second layer 20'' is adhered to the feed roller 16 from left to right (away from the wiping assembly) so as to form a seal. The excess portion of second layer 20'' within the hopper 12 is then passed through a slit 22 in lid 14 after passing through a wiper assembly including housing 24, attachment lip 25 and foam pieces 26.

The wiper assembly housing 24 is preferably formed of a plastic such as low density polystyrene fitted with two halfmoon shaped foam wiping/sealing pieces 26. Wiper assembly housing 24 is generally tubular in shape and is attached to lid 14 via an attachment area lip 25, as better shown in FIG. 4. In a preferred embodiment, wiping foam 26 comprises #2 charcoal oyster grey foam cut to very specific dimensions to have the correct wiping/sealing effect with no chance of leakage of the toner.

Finally, as shown in FIG. 1, the seal of the invention includes an end seal 28 comprised of a piece of pre-adhesived PVC applied over the breather tube vents of the disposable toner cartridge 10 to insure a complete seal. The end seals 28 are preferably set in place with the feed roller 16 in its "up" position. The end seals 28 are then hot-glued into place by hot glue 30 as shown at the left hand side of FIG. 1. Those skilled in the art will appreciate that a similar seal is formed at the right hand side of the feed roller 16; however, such a seal is not shown for ease of illustration. Once the seal strip 20 and end seal 28 are in place, toner 32 is poured into the hopper 12 as shown in FIG. 2, and the lid 14 is then sealed onto the hopper 12.

The resulting modified hopper 12 and lid 14 may be used over and over again since the lid 14, wiper assembly housing 24 and end seals 28 do not wear out during use. Thus, unlike prior art systems, the disposable toner cartridge 10 modified in accordance with the invention may be reconditioned and refilled many times.

In accordance with the invention, the following steps are performed for sealing the remanufactured toner cartridge. First, end seals 28 are formed over the feed roller 16 and mylar blades 18 at the respective ends of the feed roller 16. As noted above, the end seal 28 is formed by applying a pre-adhesived piece of PVC applied over the breather tube vents of the feed roller 16 when the feed roller 16 is in the "up" position such that a complete seal is obtained. The end seals are then hot-glued using hot glue 30 into place. Once the end seals 28 are formed, the sealing strip 20 is installed adhesive side 20″ down, from left to right in FIG. 1, so that the full length of the feed roller 16 is covered. As shown better in FIGS. 2 and 3, the adhesive portion 20″ is applied to the mylar blades 18 in contact with the feed roller 16 to form the seal. The excess length of the sealing strip 20 then hangs outside the hopper 12 until the toner 32 is added. The excess length of sealing strip 20 is then doubled back from right to left within hopper 12 and passed between the two half moon shaped foam pieces 26 within wiper assembly housing 24 and then out through slit 22. Next, the wiper assembly housing 24 is fitted and sealed to the lid 14 of the hopper 12 at the point of the lid 14 including strip 22, and the sealing strip 20 is aligned to protrude through slit 22 until pulled by the customer. Thus, before the lid 14 of the disposable toner cartridge 10 and the rest of the components are put back together, the lid 14 is modified to include the slit 22 in the upper left hand side as shown. In addition, an additional hole or slit in the exterior of the imaging cartridge "shell" is also fabricated in order to accommodate the free end of the sealing strip so that the customer will have something to pull. Preferably, a metallic laminated instruction sticker or some other such mechanism is placed on the exterior of the imaging cartridge to instruct the customer to pull the free end of the sealing strip before using the disposable toner cartridge 10.

As noted above, the sealing strip 20 is preferably approximately half an inch wide so that a seal may be formed over the feed roller 16 between the mylar blades 18, as better shown in FIGS. 2 and 3. By so sealing the toner cartridge 10 directly on the blades 18, variations in the manufacturing tolerances between the mylar blades 18 and feed roller 16 and the like as a result of use are accounted for so as to prevent toner leakage.

After the toner cartridge 10 is shipped to the customer, the customer merely pulls the sealing strip 20 through the wiper assembly housing 24 so that the foam 26 may remove the excess toner 32 from the sealing strip 20. Those skilled in the art will appreciate that the wiper assembly housing 24 also serves as a seal itself to prevent the toner 32 in the hopper 12 from leaking outside the toner cartridge 10 during shipment and during removal of the sealing strip 20. Such a seal properly installed provides a 100% effective seal while also allowing the toner cartridge 10 to be tested after remanufacturing prior to shipment without breaking the seal.

For print testing to be performed after remanufacturing, the feed roller 16 must turn freely. In other words, the sealing strip 20 must remain adhered to the mylar blades 18 but not to the feed roller 16. This is accomplished by temporarily disengaging the gear on the hopper 12 so that the large slow turning internal auger remains stationary and rotating the feed roller 16 until the seal between the sealing strip 20 and feed roller 16 only is broken while maintaining contact between the mylar blades 18 and the sealing strip 20. Toner 32 is then applied to the disengaged feed roller 16. The remanufactured disposable toner cartridge 10 is then print tested until all of the toner 32 is removed from the feed roller 16. If the print test is satisfactory, the gear on the hopper 12 is reengaged prior to shipment of the remanufactured toner cartridge 10 to the customer.

Although a single exemplary embodiment of the invention has been described in detail above, those skilled in the art will readily appreciate that many additional modifications are possible in the exemplary embodiment without materially departing from the novel teachings and advantages of the invention. For example, those skilled in the art will appreciate that a different wiping assembly besides that disclosed herein may be used to achieve the benefit of removing excess toner while maintaining a suitable seal. Also, the seal of the invention may be used in conjunction with other models of disposable imaging cartridges besides those mentioned herein. Accordingly, all such modifications are intended to be included within the scope of this invention as defined in the following claims.

What is claimed is:

1. A toner cartridge for providing toner to a developer roller of an imaging device, said toner cartridge comprising:

a hopper having a removable lid for allowing access to an internal volume within said hopper, said lid having a slit formed therein;

a feed roller at a bottom portion of said hopper for providing toner to said developer roller;

blades on respective sides of said feed roller within said hopper for regulating the flow of toner past said feed roller to said developer roller;

a sealing strip having one end thereof applied across a length of said blades and said feed roller so as to form a seal between each of said blades and said sealing strip, said sealing strip further having a free end; and a wiper assembly disposed within said hopper for accepting said free end of said sealing strip, said wiper assembly being disposed with respect to said slit so that said free end of said sealing strip may protrude out of said slit after passage through said wiper assembly, whereby said wiper assembly removes excess toner from said sealing strip when said free end of said sealing strip is pulled at said free end protruding from said slit with sufficient force to cause said sealing strip to be removed from said blades for subsequent use of said feed roller.

2. A toner cartridge as in claim 1, further comprising end seals formed over breather tube vents and said blades and feed roller at respective ends of said feed roller.

3. A toner cartridge as in claim 1, wherein said sealing strip comprises a first layer having a sticky adhesive on one side thereof for an entire length of said sealing strip and a sticky adhesive on another side of said first layer for a first length of said sealing strip approximately as long as a length of said feed roller, and a second layer adhered to said one side of said first layer for a length of said sealing strip which does not substantially overlap said first length.

4. A toner cartridge as in claim 1, wherein said wiper assembly comprises a substantially cylindrical plastic housing adhered to said lid in alignment with said slit, and a wiping foam disposed within said housing for removing said excess toner from said sealing strip when said free end of said sealing strip is pulled at said free end protruding from said slit.

5. A method of sealing and refilling a toner cartridge used to provide toner to a developer roller of an imaging device, said method comprising the steps of:

forming, at respective ends of a feed roller, end seals over breather tube vents and said feed roller, said end seals extending between blades on respective sides of said feed roller which regulate the flow of toner from a hopper of said toner cartridge past said feed roller to said developer roller;

applying one end of a sealing strip across a full length of said blades and said feed roller so as to form a seal between said respective blades above said feed roller;

refilling said toner cartridge with toner;

feeding a free end of said sealing strip through a wiper housing assembly and out through a slit in a removable lid of said hopper; and sealing said lid onto said hopper, whereby said wiper assembly removes excess toner from said sealing strip when said free end of said sealing strip protruding from said slit is pulled with sufficient force to cause said sealing strip to be removed from said blades for subsequent use of said feed roller.

6. A method as in claim 5, wherein said end seals are formed by hot gluing a pre-adhesived piece of PVC over said breather tube vents, said feed roller and said blades when said feed roller is in its operational position.

* * * * *